US009885102B2

(12) United States Patent
Kaneko et al.

(10) Patent No.: US 9,885,102 B2
(45) Date of Patent: Feb. 6, 2018

(54) COLORED PURE TITANIUM OR TITANIUM ALLOY HAVING LOW SUSCEPTIBILITY TO DISCOLORATION IN ATMOSPHERIC ENVIRONMENT

(75) Inventors: Michio Kaneko, Futtsu (JP); Kiyonori Tokuno, Tokyo (JP); Takao Wada, Tsubame (JP); Mitsuyuki Hasegawa, Tsubame (JP); Kazuo Yamagishi, Tsubame (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 722 days.

(21) Appl. No.: 11/920,486

(22) PCT Filed: May 25, 2006

(86) PCT No.: PCT/JP2006/310938

§ 371 (c)(1),
(2), (4) Date: Nov. 15, 2007

(87) PCT Pub. No.: WO2006/129737

PCT Pub. Date: Dec. 7, 2006

(65) Prior Publication Data

US 2009/0133783 A1 May 28, 2009

(30) Foreign Application Priority Data

May 31, 2005 (JP) ..... 2005-158337

(51) Int. Cl.

| | |
|---|---|
| ***C23C 8/10*** | (2006.01) |
| ***C22C 14/00*** | (2006.01) |
| ***C23C 30/00*** | (2006.01) |
| ***C25D 11/26*** | (2006.01) |
| ***C23C 28/04*** | (2006.01) |

(52) U.S. Cl.

CPC ..... *C23C 8/10* (2013.01); *C22C 14/00* (2013.01); *C23C 28/042* (2013.01); *C23C 30/00* (2013.01); *C25D 11/26* (2013.01)

(58) Field of Classification Search

CPC ..... C22C 14/00

USPC ..... 148/421, 669; 423/608; 428/386

See application file for complete search history.

(56) References Cited

U.S. PATENT DOCUMENTS

| | | | | |
|---|---|---|---|---|
| 5,156,807 | A * | 10/1992 | Nagata et al. | 420/417 |
| 2003/0168133 | A1 * | 9/2003 | Kaneko et al. | 148/518 |

FOREIGN PATENT DOCUMENTS

| | | | |
|---|---|---|---|
| EP | 1 264 913 | | 12/2002 |
| EP | 1 306 468 | | 5/2003 |
| JP | 04-107294 | | 4/1992 |
| JP | 2000-001729 | | 1/2000 |
| JP | 2002-12962 | A | 1/2002 |
| JP | 2002-47589 | A | 2/2002 |
| JP | 2004-137514 | A | 5/2004 |
| JP | 2005-272870 | | 10/2005 |
| SU | 197540 | | 9/1968 |

OTHER PUBLICATIONS

European Search Report dated Sep. 14, 2009, issued in corresponding European Patent Application No. 06756858.4.

142n0 Isij Meeting, Current Advances in Materials and Processes, Camp-Isu vol. 14, pg. 1336-1339 (2001).

* cited by examiner

*Primary Examiner* — Rebecca Lee

(74) *Attorney, Agent, or Firm* — Birch, Stewart, Kolasch & Birch, LLP

(57) ABSTRACT

The present invention provides colored pure titanium or titanium alloy having low susceptibility to discoloration in an atmospheric environment exhibiting a superior resistance to discoloration even when the titanium is used in an environment of harsh acid rain such as a roof or wall material and free from deterioration of the aesthetic appearance over a long period of time, that is, colored pure titanium obtained by the anodic oxidation method, that is, colored pure titanium or titanium alloy having low susceptibility to discoloration in an atmospheric environment characterized by having an average phosphorus content in a range of 40 nm from a surface of a titanium oxide layer formed on the titanium surface of 5.5 atomic % or less and by having an average carbon concentration in a range of a depth of 100 nm from the titanium surface of 3 to 15 atomic %.

2 Claims, No Drawings

COLORED PURE TITANIUM OR TITANIUM ALLOY HAVING LOW SUSCEPTIBILITY TO DISCOLORATION IN ATMOSPHERIC ENVIRONMENT

TECHNICAL FIELD

The present invention relates to titanium used in outdoor applications (roofs, walls, and the like), more particularly relates to colored pure titanium and titanium alloy (below, simply referred to as "colored titanium") having a low susceptibility to discoloration in an atmospheric environment.

BACKGROUND ART

Pure titanium and titanium alloy (below, simply referred to as "titanium") exhibit remarkably superior corrosion resistance in atmospheric environments, so are being used for building material applications such as roofs and walls at seaside areas. Approximately 10 years has elapsed since titanium began to be used for roofing materials and the like, but up until now there have been no examples where corrosion has been reported as occurring. However, depending on the usage environment, there are cases when the titanium surface used over an extended period of time changes to a dark gold color.

The discoloration is limited to the uppermost surface layer, so does not impair the anticorrosive function of the titanium, but from the viewpoint of aesthetic appearance, this sometimes becomes a problem. To eliminate the discoloration, the titanium surface is wiped using nitric acid, hydrofluoric acid, and other acid or the discolored part is removed by light polishing using abrasive papers and abrasive agents. When treating a large area titanium surfaces such as a roof, there are problems from the viewpoint of workability.

The cause of the discoloration in titanium still has not been sufficiently explained, but occurrence due to Fe, C, $SiO_2$, and the like suspending in the atmosphere adhering to the titanium surface and the possibility of occurrence due to an increase in the film thickness of the titanium oxide on the titanium surface are suggested. Further, as a method to reduce the discoloration, as disclosed in Japanese Patent Publication (A) No. 2000-1729, applying titanium having an oxide film of 10 nm or less on the titanium surface and given a surface carbon concentration of 30 at (atomic) % or less has been reported to being effective.

However, the present inventors carefully studied the effect of the thickness of the oxide film and carbon concentration on the surface on the discoloration using surface analysis of roofing materials made of titanium causing discoloration at different areas of Japan so as to prevent discoloration and as a result discovered that, unlike Japanese Patent Publication (A) No. 2000-1729, an oxide film thickness which is relatively thick is effective for the improvement of the resistance to discoloration. Further, in regards to the carbon, they discovered that discoloration is promoted by the carbon concentrated on the surface producing carbides.

As a result, they proposed titanium which has a relatively thick oxide film thickness and a low carbon concentration on the surface (142nd ISIJ Meeting, Current Advances in Materials and Processes, CAMP-ISIJ Vol. 14 (2001)-1336, 1337, 1338, and 1339). Further, by thickening the oxide film on the titanium surface, it is possible to reduce the carbon concentration at the titanium surface and form a titanium oxide layer as described above to greatly improve the resistance to discoloration even for colored titanium using the interaction. However, in harsh acid rain environments, the titanium oxide layer is altered in some cases, so colored titanium having a further superior resistance to discoloration is being sought.

DISCLOSURE OF THE INVENTION

In the above way, the resistance to discoloration of the titanium disclosed in the 142nd ISIJ Meeting, Current Advances in Materials and Processes, CAMP-ISIJ Vol. 14 (2001)-1336, 1337, 1338, and 1339 is good, but for colored titanium changed in color by changing the thickness of the oxide film on the titanium surface, it is desirable to further improve the resistance to discoloration in an environment with a high air temperature is high and harsh acid rain.

The present invention, in view of this situation, has as its object to provide colored titanium exhibiting a superior resistance to discoloration even when the titanium is used in an atmospheric environment such as a roof or wall material, and undergoes little deterioration in its aesthetic appearance over a long period of time, and has a low susceptibility to discoloration in an atmospheric environment.

The present invention was completed based on the above discovery and has as its gist the following.

(1) Colored pure titanium or titanium alloy having low susceptibility to discoloration in an atmospheric environment characterized by having an average phosphorus content in a range of 40 nm from a surface of a titanium oxide layer formed on the titanium surface of 5.5 atomic % or less and by having an average carbon concentration in a range of a depth of 100 nm from the titanium surface of 3 to 15 atomic %.

(2) Colored pure titanium or titanium alloy having low susceptibility to discoloration in an atmospheric environment as set forth in (1) characterized by having an average sulfur content in a range of 30 nm from the surface of the titanium oxide layer formed on the titanium surface of 0.2 to 5 atomic %.

(3) Colored pure titanium or titanium alloy having low susceptibility to discoloration in an atmospheric environment as set forth in (1) or (2) characterized by having a thickness of the titanium oxide layer formed on the titanium surface of 40 to 60 nm.

BEST MODE FOR CARRYING OUT THE INVENTION

The present inventors intensively studied improvement of the resistance to discoloration of colored titanium in an environment of harsh acid rain whereupon they discovered that it is possible to remarkably improve the resistance to discoloration of the colored titanium by the reduction of the concentration of phosphorus in the titanium oxide layer on the titanium surface and by the content of the sulfur. Below, the case of pure titanium will be used for a detailed explanation, but the same can be applied even in the case of a titanium alloy.

Colored titanium is generally industrially produced by a method called the "anodic oxidation method". The anodic oxidation method is a method of immersing titanium in an aqueous solution, applying voltage between titanium as an anode and a suitable material of a cathode, changing the voltage to change the thickness of the titanium oxide layer of the titanium surface, and thereby fabricating colored titanium of various colors. However, the colored titanium obtained by the anodic oxidation method had the concern that in an environment of a high average air temperature and a low pH of the rainwater, that is, a harsh acid rain, the titanium oxide layer formed by the anodic oxidation method is transformed and discolored.

The inventors discovered that to prevent this kind of transformation, reducing the phosphorus content in the titanium oxide layer works very effectively. The transformation of the titanium oxide layer is a phenomenon involving the surface of the titanium oxide layer, so it is necessary to make the phosphorus content in the titanium oxide layer in the range of 40 nm from the surface of the titanium oxide layer 5.5 atomic % or less.

There are still unclear points regarding the effect of phosphorus in the transformation of the titanium oxide layer, but by including the phosphorus in excess of 5.5 atomic %, it is believed that the titanium oxide layer easily dissolves in a high temperature rainwater solution or low pH acid rain.

The phosphorus content in the range of 40 nm from the surface of the titanium oxide layer is defined since what is involved in the dissolution of the titanium oxide layer is the surface layer such as the titanium oxide layer.

Furthermore, regarding the titanium carbides of the titanium surface layer, it is necessary to reduce the average carbon concentration in the range of 100 nm from the titanium surface to 15 atomic % or less. If this carbon concentration is in excess of 15 atomic %, the formation of titanium carbide is promoted and the resistance to discoloration decreases. However, the carbon concentration is made less than 3 atomic % since the effect of improving the resistance to discoloration by reduction of the carbon is saturated, so the lower limit of the carbon concentration is made to 3 atomic %. Regarding the lower limit, it is preferable to make it 10 atomic % from the viewpoint of the production costs.

Further, the range of 100 nm from the titanium surface is set since for the titanium carbide to dissolve to form a titanium oxide layer and for the interaction to cause discoloration, a thickness of at least half the wavelength of visible light is required. By way of reference, when there is titanium carbide in the range less than 100 nm from the titanium surface, for example, even if the titanium carbide in that region dissolves and forms titanium dioxide, no interaction is caused.

Furthermore, the resistance to discoloration of colored titanium is greatly improved by making the average sulfur content in the range of 30 nm from the surface of the titanium oxide layer formed on the titanium surface 0.2 to 5 atomic %, so is preferable. Sulfur, contrary to the case of phosphorus, is believed to raise the chemical stability of the titanium oxide layer by being contained in a suitable quantity in the titanium oxide layer and to be remarkably effective in suppressing the dissolution of the titanium oxide layer in high temperature rainwater or in low pH rainwater. To obtain this effect, 0.2 atomic % or more of sulfur is preferably contained in the range of 30 nm from the surface of the titanium oxide layer. However, if contained in excess of 5 atomic %, conversely the dissolution of the titanium oxide layer in the above environment is easily promoted, so the preferred upper limit of the sulfur content is made 5 atomic %. Here, the sulfur content in a range of 30 nm is defined, in the same way as described above, because what is involved in the dissolution of the titanium oxide layer is the uppermost surface layer of the titanium oxide layer.

Note that the effect of improvement of the resistance to discoloration of colored titanium is closely relationship to the thickness of the titanium oxide on the titanium surface. To further improve the resistance to discoloration, it is desirable that the thickness of the titanium oxide be in the range of 40 to 60 nm. This presumes that the thinner the thickness of the titanium oxide layer, the better the chemical stability of the titanium oxide layer formed.

However, if the thickness of the titanium oxide layer is less than 40 nm, the film thickness is thin, so a sufficient corrosion prevent effect cannot be obtained. Further, if the thickness of the titanium oxide layer exceeds 60 nm, the effect of improvement of the corrosion prevention effect due to the increase of the film thickness becomes saturated, so 60 nm was made the upper limit.

Note that if the thickness of the titanium oxide layer exceeds 60 nm, rather the thicker the thickness of the titanium oxide layer, the better the resistance to discoloration tends to become. In particular, colored titanium having a thickness of the titanium oxide layer exceeding 150 nm is preferable.

The average phosphorus concentration (atomic %) or average sulfur concentration (atomic %) at a predetermined range from the surface of the titanium oxide layer formed on the titanium surface in this way, the thickness of the titanium oxide layer, and the average carbon concentration (atomic %) of 100 nm from the titanium surface can be measured using a surface analyzer such as an Auger electron spectroscope. That is, these can be found by performing the analysis in the depth direction from the titanium surface while selecting appropriate analysis intervals.

To analyze the phosphorus content in the titanium oxide layer in the range of 40 nm from the surface of the titanium oxide layer or analyze the sulfur content in the titanium oxide layer in the range of 30 nm from the surface of the titanium oxide layer, it is desirable to obtain 10 or more measurement points in at least the depth direction, so it is desirable to conduct the measurement at intervals of 3 nm or less. Note that the depth from the titanium oxide surface is calculated by using an $SiO_2$ film measured for thickness in advance by ellipsometer and converting from the sputtering rate (nm/min) of $SiO_2$ found under the same measurement conditions.

The thickness of the titanium oxide layer is determined, when performing the Auger analysis in the depth direction from the surface of the titanium oxide layer, by finding the sputtering time at the position where the oxygen concentration decreases by half in the measurement values of the oxygen concentration on the titanium oxide layer surface, multiplying the sputtering rate found using the above $SiO_2$ and the sputtering time, and calculating the oxide film thickness. Here, the position where the oxygen concentration on the titanium surface decreases by half is set since it is possible to perform the measurement by a high reproducibility without regard as to the vacuum degree in the analyzer.

In the anodic oxidation method, various coloring solutions have been used in the past, but most of them are designed for improvement of the adhesion of the titanium oxide layer or the evenness or brightness of the color. None has as its object the improvement of the resistance to discoloration and as its object the production of colored titanium having the above surface composition and thickness of the titanium oxide layer. For example, to suppress the content of phosphorus in the titanium oxide layer, it would seem preferable not to include compounds containing phosphorus in the coloring solution, but from the viewpoint of the brightness or adhesion of the titanium oxide layer, addition of phosphoric acid becomes unavoidable. Therefore, the content of phosphorus in the range of 40 nm from the surface of the titanium oxide layer becomes important, so it is important to set a suitable concentration of phosphorus acid in the coloring solution and quickly and sufficiently wash the surface after anodic oxidation so as to remove the phosphorus on the surface of the titanium oxide layer. Alternatively, a method of removing the phosphorus by heating at a predetermined heat treatment temperature after coloration is also effective.

Further, the carbon concentration at the titanium surface can be controlled by washing after cold rolling or optimizing the vacuum annealing conditions (annealing temperature and the like).

Further, to include sulfur in the titanium oxide layer, a coloring solution set to a suitable concentration of sulfuric acid in the coloring solution is used with the anodic oxidation method to form a titanium oxide layer containing some sulfur.

Furthermore, the thickness of the oxide layer on the titanium surface can be controlled by controlling the voltage of the anodic oxidation or the treatment time. The above various conditions and the like are not specifically defined and may be suitably set.

An exterior material, ease of working is sought, so usually JIS Type 1 industrial use titanium is used, but by applying the titanium of the present invention, it is possible to give a high resistance to discoloration to the exterior material.

Further, as the titanium of the present invention, the invention can also be applied to the JIS Type 2 to Type 4 industrial use titanium used for cases where strength is required. Furthermore, as stated above, the content explained for the titanium of the present invention can also be similarly applied to titanium alloy. Here, as the "titanium alloy", for example, JIS Type 11 to Type 23 etc. including trace amounts of precious metal-based elements (palladium, platinum, ruthenium, and the like) in order to improve corrosion resistance may be mentioned.

Note that in an titanium alloy with an alloy element concentration of over several mass % (high strength), at the time of anodic oxidation, the alloy element is selectively dissolved or concentrated in the titanium oxide layer to greatly reduce the coloring of the colored titanium or adhesion of the titanium oxide layers, so when applying the present invention to the titanium alloy, it is important to examine the effects of the alloy element beforehand.

EXAMPLES

The inventors used 0.4 mm thick JIS Type 1 pure titanium cold rolled annealed sheets and formed titanium oxide layers on the titanium surfaces by the anodic oxidation method in solutions of sulfuric acid and phosphoric acid mixed together in concentrations changed in various ways so as to change the average phosphorus contents in the ranges of 40 nm from the surfaces of the titanium oxide layers and the average sulfur contents in the ranges of 30 nm from the surfaces of the titanium oxide layers. Further, they changed the voltage of the anodic oxidation so as to change the thicknesses of the oxide layers on the titanium surfaces. Further, they adjusted the carbon concentration on the titanium surface by changing the vacuum annealing temperature after cold rolling.

Table 1 shows the results of measurement of the average phosphorus concentration and the average sulfur concentration in predetermined ranges from titanium oxide layer surface, the thickness of the titanium oxide layer, and the average carbon concentration in the range of a depth of 100 nm from the titanium surface using an Auger electron spectroscope and the results of measurement of the color difference of the titanium before and after testing at the time of running a 2 weeks immersion test on samples of these in a sulfuric acid aqueous solution with a pH of 4 at 40° C. (simulating effect of acid rain) and evaluation of the resistance to discoloration.

The color difference before and after testing (ΔE) was calculated by $$\Delta E=\{(L^*_2-L^*_1)^2+(a^*_2-a^*_1)^2+(b^*_2-b^*_1)^2\}^{1/2}$$

Here, $L^*_1$, $a^*_1$, and $b^*_1$ are the measured results of the color before discoloration testing, $L^*_2$, $a^*_2$, and $b^*_2$ are the measured results of the color after discoloration testing, both based on the L*, a*, and b* color specification method stipulated in the JIS Z8729 method.

Naturally, the smaller the value of the color difference, the more superior the resistance to discoloration, but according to the present invention method, when the average phosphorus concentration in the range of 40 nm from the surface of the titanium oxide layer is 5.5 atomic % or less and the average carbon concentration in the range of the depth of 100 nm from the titanium surface is in the range of 3 to 15 atomic %, the resistance to discoloration was good.

Furthermore, it is understood that the average sulfur concentration in the range of 30 nm from the surface of the titanium oxide layer being from 0.2 atomic % to 5 atomic % and the thickness of the titanium oxide layer being in the range of 40 to 60 nm are particularly superior in resistance to discoloration.

TABLE 1

| | Average phosphorus concentration in range of 40 nm from titanium oxide layer surface (atomic %) | Average carbon concentration by depth in range of 100 nm from titanium surface (atomic %) | Average sulfur concentration in range of 30 nm from titanium oxide layer surface (atomic %) | Thickness of titanium oxide layer (nm) | Color difference (before and after discoloration test) ΔE) |
|---|---|---|---|---|---|
| Inv. ex. 1 | 0.1 | 9.2 | 0.1 or less | 82.3 | 3.5 |
| Inv. ex. 2 | 0.5 | 11.5 | 0.1 or less | 127.5 | 3.3 |
| Inv. ex. 3 | 3.2 | 6.3 | 0.1 or less | 86.5 | 3.7 |
| Inv. ex. 4 | 0.1 or less | 3.5 | 0.8 | 150.6 | 2.1 |
| Inv. ex. 5 | 0.1 or less | 12.4 | 3.6 | 338.0 | 2.2 |
| Inv. ex. 6 | 0.7 | 7.2 | 1.2 | 607.2 | 2.4 |
| Inv. ex. 7 | 0.1 or less | 6.5 | 0.1 or less | 42.6 | 1.2 |
| Inv. ex. 8 | 0.1 or less | 5.8 | | 58.5 | 1.0 |
| Comp. ex. 1 | 7.8 | 10.3 | 0.1 or less | 243.6 | 7.8 |
| Comp. ex. 2 | 0.1 or less | 20.4 | 0.1 or less | 56.4 | 8.9 |

INDUSTRIAL APPLICABILITY

The colored titanium of the present invention has remarkably superior corrosion resistance in an atmospheric environment and is particularly effective for applications in an outdoor environment such as roofs or wall panels.

The invention claimed is:

1. A colored titanium alloy having low susceptibility to discoloration in an atmospheric environment, the colored titanium comprising a titanium material and a titanium oxide layer formed on a surface of the titanium material, wherein the titanium oxide layer has a thickness of over 40 nm and up to 607.2 nm, an average phosphorus content of 5.5 atomic % or less in a range of a depth of 40 nm from the surface of the titanium oxide layer, and an average sulfur content of 0.2 to 5 atomic % in a range of a depth of 30 nm from the surface of the titanium oxide layer, wherein the titanium material has a surface layer having an average carbon concentration of 3 to 15 atomic % in a range of a depth of 100 nm from a boundary of the titanium material and the titanium oxide layer.

2. The colored titanium alloy as set forth in claim 1, wherein the colored titanium is produced by an anodic oxidation method.

* * * * *